United States Patent [19]

Yamane

[11] Patent Number: 4,811,686

[45] Date of Patent: Mar. 14, 1989

[54] DEVELOPING DEVICE OF AN ELECTROPHOTOGRAPHIC MACHINE

[75] Inventor: Hidenobu Yamane, Yamatokoriyama, Japan

[73] Assignee: Sharp Kabushiki Kaisha, Osaka, Japan

[21] Appl. No.: 31,187

[22] Filed: Mar. 27, 1987

Related U.S. Application Data

[63] Continuation of Ser. No. 822,936, Jan. 27, 1986, abandoned, which is a continuation of Ser. No. 532,962, Sep. 16, 1983, abandoned.

[30] Foreign Application Priority Data

Sep. 17, 1982 [JP] Japan ..... 57-162768

[51] Int. Cl.[4] ..... G03G 15/09

[52] U.S. Cl. ..... 118/657; 118/658; 355/3 DD

[58] Field of Search ..... 118/657, 658; 355/3 DD

[56] References Cited

U.S. PATENT DOCUMENTS

| | | | |
|---|---|---|---|
| 4,348,979 | 9/1982 | Daintrey | 118/658 X |
| 4,373,798 | 2/1983 | Tsukuda et al. | 118/658 X |
| 4,377,332 | 3/1983 | Tamura | 118/658 X |

*Primary Examiner*—Bernard Pianalto

*Attorney, Agent, or Firm*—Birch, Stewart, Kolasch & Birch

[57] ABSTRACT

A developing device of an electrophotographic apparatus comprising a light-sensitive member for forming an electrostatic latent image, a developing roller comprising a magnetic roller and a sleeve, the developing roller supplying a developer which is to be magnetized in the same polarity as that of the electrostatic latent image while the developer is adhered on the sleeve by a relative-rotational speed between the sleeve and the magnetic roller, and regulating means for regulating the thickness of the developer on the sleeve to be approximately equal to the distance between the light-sensitive member and the sleeve.

2 Claims, 2 Drawing Sheets

DEVELOPING DEVICE OF AN ELECTROPHOTOGRAPHIC MACHINE

This application is a continuation of application Ser. No. 822,936 filed on Jan. 27, 1986 now abandoned, which is a continuation of application Ser. No. 532,962 filed on Sept. 16, 1983 now abandoned.

BACKGROUND OF THE INVENTION

The present invention relates to a developing device and to a method for developing visible electrostatic latent images formed on a light-sensitive member using an electrophotographic apparatus. More particularly, the present invention relates to a developing device of an electrophotographic machine which developes by using both a developer, such as a one-component magnetic toner powder, and electrostatic latent images.

Conventional developing devices of conventional electrophotographic apparatus have been developed by utilizing a toner charged with polarities opposite to that of the electrostatic latent image on a light-sensitive member. One such developing device is disclosed in S. Nelson, U.S. Pat. No. 4,121,931 entitled "ELECTROGRAPHIC DEVELOPMENT PROCESS" issued on Oct. 24, 1978.

Conventionally and as disclosed in the above U.S. Patent, as the toner is usually charged with a polarity opposite to that of the electrostatic latent image, regardless of whether it is a contact development or a non-contact development, the toner adheres to the non-image region, and thus copies are damaged, especially, they are smeary or are scattered copied images.

This is because charges having a polarity similar to that of an image section remain on a non-image section on the paper at the developing stage. That is, a toner charged with polarity opposite to that of the image section is attracted from a toner supplied on the non-image section on the paper by the remaining charges on the non-image section.

SUMMARY OF THE INVENTION

With the foregoing in mind, it is an object of the present invention to provide an improved developing device and method using an electrophotographic apparatus for improving copy performance.

It is another object of the present invention to provide an improved developing device and method using an electrophotographic apparatus which develops with a developer, such as a one-component toner powder, and the electrostatic latent images both being charged with the same polarity.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

According to an embodiment of the present invention, the developing device of an electrophotographic machine comprises a light-sensitive member for forming an electrostatic latent image thereon, and a developing roller comprising a magnetic roller and a sleeve, the developing roller supplying a developer which is to be magnetized in the same polarity as that of the electrostatic latent image while the developer is adhered on the sleeve by a relative-rotation speed between the sleeve and the magnetic roller, and regulating means for regulating the thinkness of the developer on the sleeve to be approximately equal to the distance between the light-sensitive member and the sleeve.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
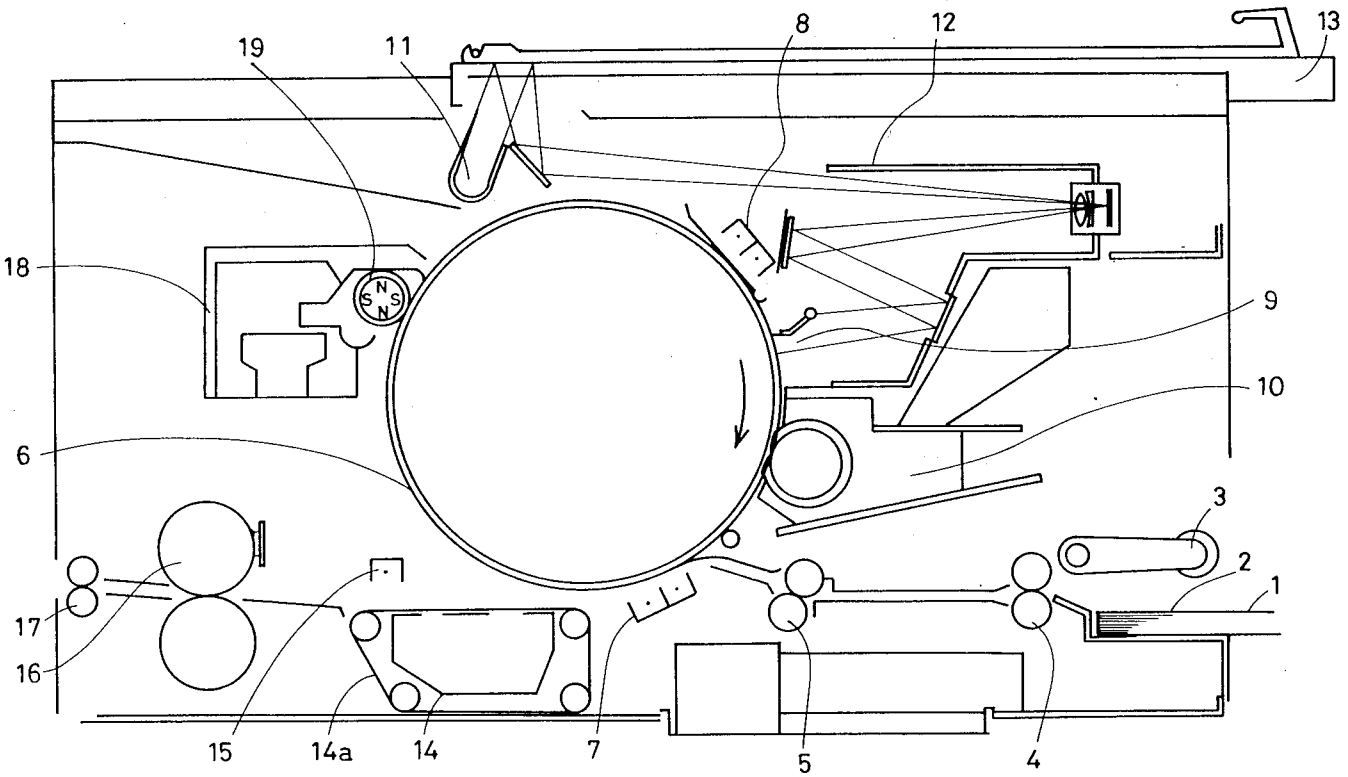
FIG. 1 is a diagrammatic cross-sectional view of an electrophtographic machine according to present invention.

The plain paper copy sheet 2 passes through a paper feeding section, a transference section and a fixing section and the copied sheet 2 is discharged from a paper outlet as described herein below.

A plurality of plain paper copy sheets 2 are stacked within a cassette 1. A feed roller 3 is positioned on the plain paper copy sheets 2 disposed in the housing of the electrophotographic apparatus in response to a copy start signal applied therto.

The plain paper copy sheet 2 picked up by the feed roller 3 is transferred into a developing device 10 as described below by a pair of feed rollers 4 and other feed roller 5. An image of an original document is produced on a light-sensitive member 6 in the form of a toner powder pattern. The image is developed on the plain paper copy sheet 2 using a transferrence charger 7. The light-sensitive member 6 comprises a master film including a zinc oxide coating tightly adhered to a rotary drum.

Around the light-sensitive member 6 there are provided a charger 8 for charging the surface of the light-sensitive member 6, an exposure section 9 for projecting reflection light from the original document toward the drum and the developing device 10 for developing the reflection light images on the light-sensitive member 6 by depositing toner powder corresponding to the reflection light images thereon. The reflection light image is formed by applying light from an illumination section 11 upon the original document. The original document is disposed on a transparent plate and optical system 12 to provide the reflection light images on the exposure section 9. A document plate 13 including the transparent plate is removed in accordance with the rotation of the drum to achieve slit exposure as is well known.

The toner powder employed for the electrophotographic machine of the present invention is magnetic one-component developer comprising polystrene resin containing a negative charge controller. Preferably, the resistance value of the toner powder is selected in the order of $10^{15}$–$10^{18}$ Ω·cm.

One component developers or two-component developers are generally used as the developer for the electrophotographic machine. When the two-component developers are used, a developer stirring means for causing friction on the toner and for charging it is required in addition to a development roller. But advantageously, when the one-component developers are used, the developer stirring means is not needed. Accordingly, the structure of the developing device using the one component developer can be simpler than that of the two-component developer.

Figure 2:
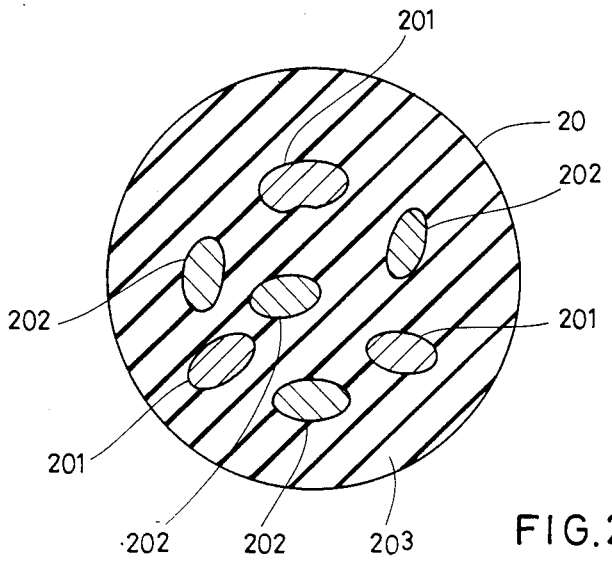
FIG. 2 is a cross-sectional view of an example of a developer adapted to the electrophotographic machine shown in FIG. 1.

As an example of the one-component toner, FIG. 2 shows in a cross-sectional view the toner powder having a resistance of $10^{15}$–$10^{18}$ Ω·cm. The toner powder 20 comprises, for example, 55.6% of magnetite powder 201, 7.4% of conductive carbon black 202 and 37% of polystyrene resin 203. The diameter of the toner powder grain is 15μ. Any other type of the toner particles can be selected as the toner used for the present invention.

The toner particles are transferred to the developing device 10 by the magnetically attractive force of a magnet roller within the developing section 10. The toner powder images formed on the light-sensitive member 6 are developed on the plain paper copy sheet 2 through the transference charger 7. Assume now the transference charger 7 is charged with a polarity opposite to that of the charger 8. The plain paper copy sheet 2 is strictly adhered to the light-sensitive member 6 for transference purposes.

A paper suction member 14 is provided for drawing the plain paper copy sheet 2 with air therein for removal from the light-sensitive member 6. The plain paper copy sheet 2 is then placed on a belt **14*a* while carrying the toner powder images thereon. A charge removal component 15 is disposed above the paper suction member 14 for removing the remaining charge on the plain paper copy sheet 2**.

When the plain paper copy sheet 2 reaches fixing roller 16 by being conveyed on the belt **14*a*, the toner powder is strongly pressed on the copy sheet 2 and adhered thereto. The toner powder images are strictly fixed on the plain paper copy sheet 2. After passing through the fixing rollers 16, the plain paper copy sheet 2 is sent to feed rollers 17** to be discharged from the housing of the electrophotographic machine.

A cleaner 18 is provided in the neighborhood of the drum for removing the remaining toner powder, which has not been adhered to the plain paper copy sheet 2, from the surface of the light-sensitive member 6 during the transference procedure. The cleaner 18 comprises a magnetic roller 19 which magnetically attracts the toner powder in accordance with the rotation of the light-sensitive member 6.

Figure 3:
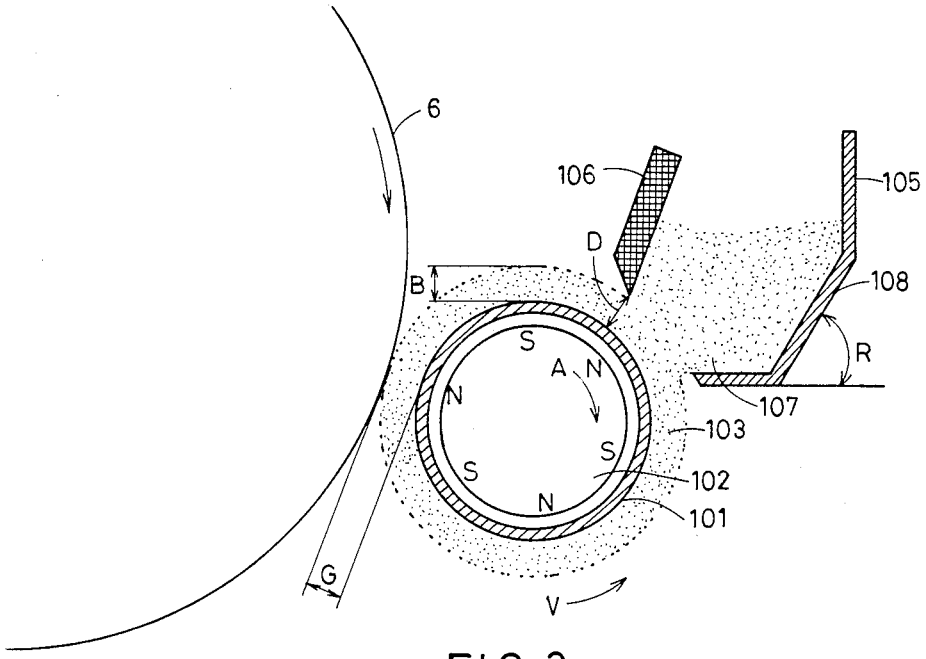
FIG. 3 is a sectional view of a developing device incorporated within the electrophotographic machine shown in FIG. 1.

FIG. 3 is a sectional view of the developing device 10 incorporated within the electrophotographic machine. The developing device comprises a developing roller comprising a cyrindrical sleeve 101 and a magnetic roller 102, a light-sensitive member 6, and supply hopper 105. The cylindrical sleeve 101 comprises a non-magnetic material. The magnetic roller 102 is rotatably provided in the sleeve 101. The roller 102 has alternative polarities at the periphery.

A one-component toner 13 is disposed around the sleeve 101 by the magnetic force of the magnet roller 102. The light-sensitive member 6 rotates in the direction of the arrow. The electrostatic latent images have already been formed on the drum-type light-sensitive member 6.

The toner 103 is maintained in the supply hopper 105. The toner 103 is supplied to the sleeve 101 after the toner flows downwardly on an inclined plate 108 having an inclined face disposed at an angle R. The hopper 105 is provided with a lower opening 107.

A toner control plate 106 for maintaining a constant toner amount supplied around the sleeve 101 is positioned at a distance D from the sleeve 101. The toner control plate 106 controls the amount of toner 103 which is adhered magnetically around the sleeve 101 in order to transmit the toner in a fixed amount to the developing region for contact with the face of the light-sensitive member 6. Accordingly, the amount of the toner on the sleeve 101 is usually constant. The thickness B of the toner 103 around the sleeve 101 is kept constant while the magnet roller 102 is rotated.

In the present invention, the toner 103 is charged with the same polarity as that of the electrostatic latent image on the light-sensitive member 6 by the friction between the toner powders themselves and between the sleeve 101 and the toner 103.

As the space G between the sleeve 101 and the light-sensitive member 6 is made narrower and the thickness B is made thinner, the field strength between the light-sensitive member 6 and the sleeve 101 is stronger because of the electrostatic latent image formed on the light sensitive member. Accordingly, the light-sensitive member 6 strongly attracts the toner powders.

The space G may be set, preferably, about 0.2 mm–0.5 mm. If the space G is larger than 1 mm, the field strength between the light-sensitive member 6 and the sleeve 101 is poor, so that the force for attracting the toner 103 is poor.

In the above construction, the relative-rotational speed of the sleeve 101 and the magnet roller 102 is kept fixed, so that the toner 103 is charged by friction in the same polarity as that of the electrostatic latent images on the light-sensitive member 6. Because the space G between the sleeve 101 and the light-sensitive member 6 is made narrower and the full strength between the sleeve 101 and the light-sensitive member 6 is stronger, an apparent resistance between the member 6 and the sleeve 101 is reduced.

Although the toner 103 is charged by friction in the same polarity as that of the electrostatic latent images, and the toner 103 and the electrostatic latent images on the light-sensitive member 6 repel each other, the toner 103 received a large number of reverse-polarized charges. These charges are supplied from the sleeve 101 by an electrostatic induction due to the accumulated field effect, an inductive polarization of the toner 103 itself or the like. Hence, a greater attractive force is produced between the toner 103 and the electrostatic latent image on the light-sensitive member 6. Thus, the attractive force which overcomes a the repulsion force caused by the frictional charging is produced on the toner 103, so that the toner 103 is attracted to the light-sensitive member 6, and the toner image pattern is formed on the light-sensitive member 6.

On the other hand, the field strength formed at the non-image region on the light-sensitive member 6 is much smaller than that of the image region, so that the attractive force which can overcome the repulsion force between the toner 103 and the non-image region is not produced between the toner 103 and the non-image region. Hence, the toner 103 is not attracted on the non-image region of the light-sensitive member 6.

According to the knowledge of the skilled in the art, the toner 103 can be formed as being charged in the same polarity as that of the light-sensitive member 6, depending on the nature of the charge controller.

The following is a preferred embodiment of the present invention.

The developing roller is positioned opposite to the light-sensitive member 6, and the space G between the light-sensitive member 6 and the sleeve 101 is about 0.3 mm. The thickness B of the toner layer 103 is set at about 0.3 mm by the toner control plate 106. The magnet roller 102 which presents a peripheral surface of 6 polarities of 1000 gauss, is rotated in the direction of the arrow A at 500 rpm, and the sleeve 101 which is made of stainless steel or aluminium is rotated at 200 rpm The light-sensitive member 6 comprises an organic optical conductor, and the electric potential of the electrostatic latent image is set about −500 V. The toner 103 comprises polystrene resin containing a negative charge controller, so that the toner particles are negatively charged. The resistance value of the toner is set at about $1.0\times10^{15}$ Ω·cm. The toner 103 is charged to about −50 V on the sleeve 101.

It is possible that the member 6 can be charged with a positive polarity by selecting a positive charge controller. The space G between the light-sensitive member 6 and the sleeve 102, and the thinkness B of the toner 103 on the sleeve 101 may be approximately equal.

The invention being thus described, it will be obvious that the same may be varied in many ways. Such variations are not to be regarded as a departure from the spirit and scope of the invention, and all such modifications are intended to be included within the scope of the following claims.

I claim:

1. A developing device for an electrophotographic copying apparatus of the type that utilizes toner particles for developing an image on a light-sensitive member, said apparatus comprising:

a rotatable light-sensitive member on which an electrostatic latent image can be formed;

means for charging said light-sensitive member with an electrostatic latent image having a charge of a pre-determined polarity;

means for providing toner particles and for charging said toner particles with a charge of the same polarity as that of an electrostatic latent image formed on the light-sensitive member;

a rotatable developing roller comprising a magnetic roller and a sleeve, said sleeve being rotated relative to said magnetic roller, whereby said toner particles are charged and fed by said developing roller due to frictional charging of the toner particles rubbing against themselves and with said sleeve resulting from the relative rotational speed between said sleeve and said magnetic roller; and regulating means for regulating the thickness of said toner particles on said sleeve to be approximately equal to the distance between the light-sensitive member and the sleeve.

2. The developing device of the electrophotographic apparatus of claim 1, wherein the distance between the light-sensitive member and the sleeve is set a about 0.2 mm–0.5 mm.

* * * * *